US005131342A

United States Patent [19]

Sackett

[11] Patent Number: 5,131,342

[45] Date of Patent: Jul. 21, 1992

[54] SHALLOWDRAFT FLOATING BOATLIFT

[76] Inventor: James A. Sackett, 620 Hampshire La., Holmes Beach, Fla. 34217

[21] Appl. No.: 553,251

[22] Filed: Jul. 16, 1990

Related U.S. Application Data

[63] Continuation-in-part of Ser. No. 229,928, Aug. 8, 1988, abandoned.

[51] Int. Cl.[5] ..... B63C 1/02

[52] U.S. Cl. ..... 114/48; 114/45; 114/49; 114/344; 280/414.1

[58] Field of Search ..... 114/44, 45, 49, 50, 114/263, 344, 48; 280/414.1, 414.3; 405/1, 3; 187/24

[56] References Cited

U.S. PATENT DOCUMENTS 110,564 12/1870 Gowen ..... 114/49

3,265,024 8/1966 Kramlich ..... 114/45

4,732,102 3/1988 Holman et al. ..... 114/45

FOREIGN PATENT DOCUMENTS 1104053 7/1984 U.S.S.R. ..... 114/49

*Primary Examiner*—Sherman D. Basinger

*Assistant Examiner*—Thomas J. Brahan

[57] ABSTRACT

A boatlift including two floatation chambers operably engaged to a boat hull engaging means by a lifting means connected therebetween. The lifting means is adapted to raise and lower the boat hull engaging means with respect to the floatation chambers, which, in turn, is adapted to buoyantly support both the boat hull engaging means and the lifting means. The boat lift may be either connectable to a stationary object such as a dock, pier or seawall, or may be adapted to be trailerable by land vehicle.

9 Claims, 4 Drawing Sheets

SHALLOWDRAFT FLOATING BOATLIFT

This is a continuation-in-part of application Ser. No. 07/229,928 filed Aug. 8, 1988, now abandoned.

BACKGROUND OF THE INVENTION

This invention relates generally to docking and trailering means for boats, and more particularly to a floatable boatlift for raising a boat from the water during storage and servicing.

As an alternative to mooring and storing a boat in the water tied to a pier or bulkhead, in addition to dry storage, two well-known devices are available to a boat owner. The first is in the form of a conventional boat trailer wherin the boat may be hoisted atop the trailer and removed from the water by a towing vehicle.

The second option generally available is in the form of a floating dock. This system includes a pair of spaced apart parallel, elongated floatation chambers which may be filled with water as required. Structures connected between these floatation chambers are adapted to engage the hull of the boat and to support same thereatop. In order to utilize this well-known system, the floatation chambers are filled with water to submerge the entire system, whereupon the boat may be driven or pulled in position directly over the center hull engaging member. Thereafter, the water is pumped from the floatation chambers, whereupon the entire system and the boat thereatop are raised above the surface of the water.

Significant limitations are associated with such floatable docks. One such limitation resides in conjunction with the potential imbalance during filling of the floatation chambers whereupon the entire system may roll or pitch within the water-carrying with it the potential of the boat sliding from its resting position into the water. An additional limitation resides in the deeper water required in order to completely submerge this assembly beneath the waterline so that the boat may be driven or pulled thereover.

With regard to towable boat trailers, applicant is unaware of any significant floatation means in conjunction therewith which would render these devices floatable.

The present invention provides a boatlift which may be provided in a form which is tieable to a stationary object such as a pier or seawall or may be made towable behind a land vehicle. The floatation chamber is moveable upwardly and downwardly in relation to the boat hull engaging member so that the boat placed thereatop may be conveniently raised and lowered without any of the undue limitationhs heretofore described.

BRIEF SUMMARY OF THE INVENTION

This invention is directed to a boatlift including two floatation chambers operably engaged to a boat hull engaging member by a lifting member connected therebetween. The lifting member is adapted to raise and lower the boat hull engaging member with respect to the floatation chambers, which, in turn, are adapted to buoyantly support both the boat hull engaging member and the lifting member. The boat lift may be either connectable to a stationary object such as a dock, pier or seawall, or may be trailerable by land vehicle.

It is therefore an object of this invention to provide a boatlift which is connectable to a stationary object such as a pier or bulkhead and which will supportively receive a boat placed thereatop to be raised above the water by this invention.

It is another object of the above invention which minimizes the depth of water required for full functioning thereof.

It is another object of the above invention to provide a boatlift which may be towable by a land vehicle and which provides upward and downwardly moveable floatation chambers to facilitate raising a boat placed thereatop from the water both at a boat ramp and in open water, if required.

In accordance with these and other objects which will become apparent hereinafter, the instant invention will now be described with reference to the accompanying drawings in which:

DETAILED DESCRIPTION OF THE INVENTION

This invention relates generally to docking a boat above the water and more specifically to a shallowdraft floating boatlift for raising a boat above the water for servicing and storage; This concept being adaptable to an existing boat trailer.

This system is comprised of two floatation tanks (FIGS. 1—1*a* and 1*b*) equipped with bilge pumps for raising and lowering (not submerging) the tanks.

The tanks will be connected with two fixed beams (FIGS. 1—3*a* and 3*b*) at the bottom of the tanks for the purpose of separating and stabilizing the tanks at the width of the boat to be lifted creating essentially a binary (or catamaran) system. In addition there will be two movable lifting beams (FIGS. 1—2*a* and 2*b*) one fore and one aft of the fixed beams, upon which the boat will be cradled. Each extreme end of the lifting beams will be affixed to a feed screw (FIGS. 2—8) for the purpose of raising and lowering said beams. This could be accomplished in other ways; but for the purpose of this invention, the inventor intends to utilize threaded rod (worm gears).

OPERATIONAL SUMMARY

The unique shallow draft operation of this boatlift is accomplished by combining two existing physical principles. The first principle is buoyancy. Lift and draft (height and depth), are accomplished by pumping water in or out of said tanks. The tanks reduce in height as water is pumped in and increase in height as water is pumped out. There is 57.14 pounds of lift per cubic foot of displacement (Oxford Companion to Ships and the Sea). The second principle is mechanical: the intended application being an inclined plane (feed screw). The height and draft of the lift beams are exchanged by screwing the lift beams up or down.

Figure 1:
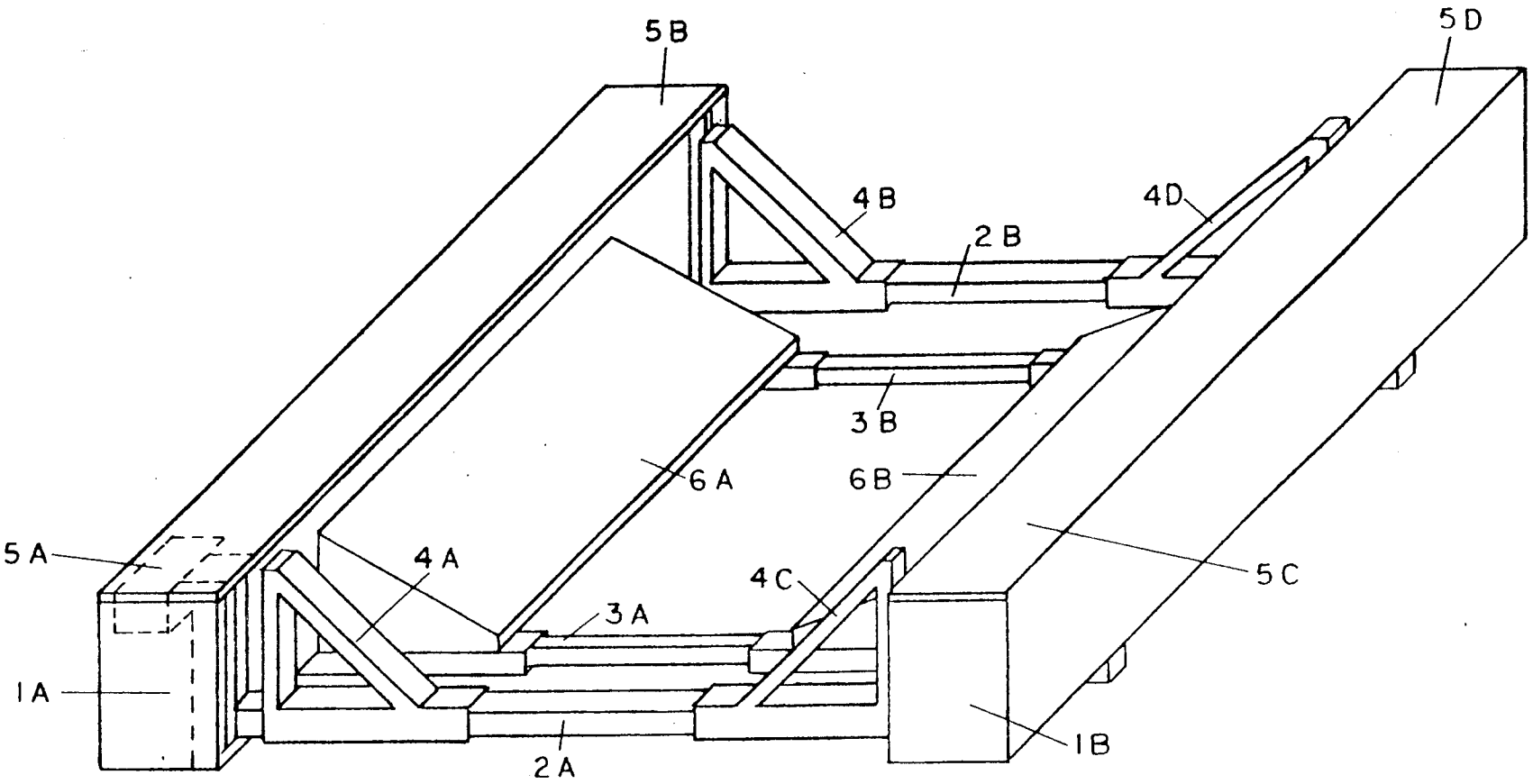
FIG. 1 is a three dimentional view of the invention.
Figure 2A:
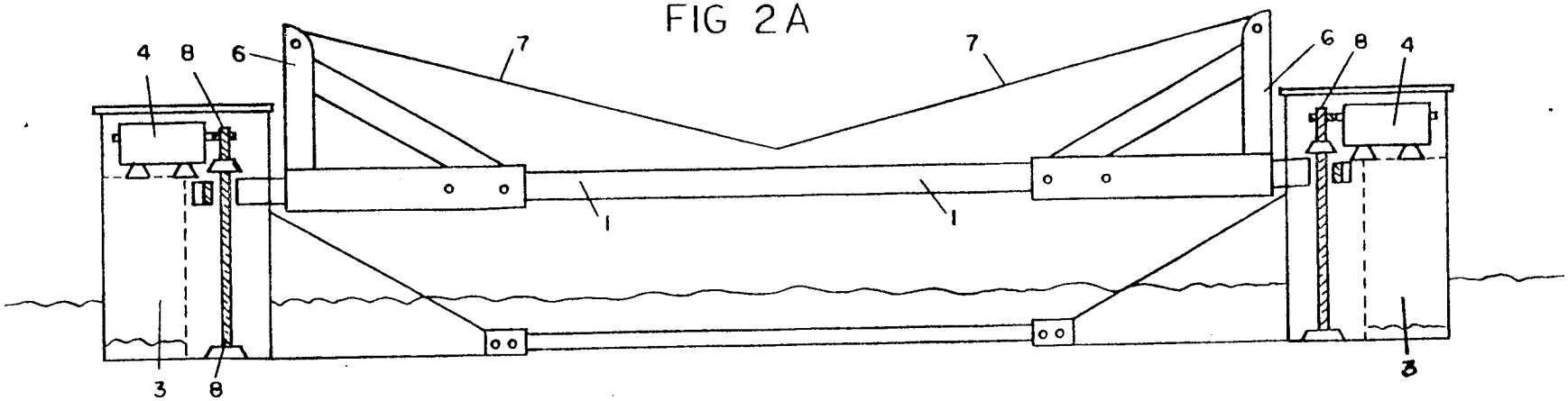
FIG. 2*a* is an end view of one half of the system showing the tanks empty and lift beams up.
Figure 2B:
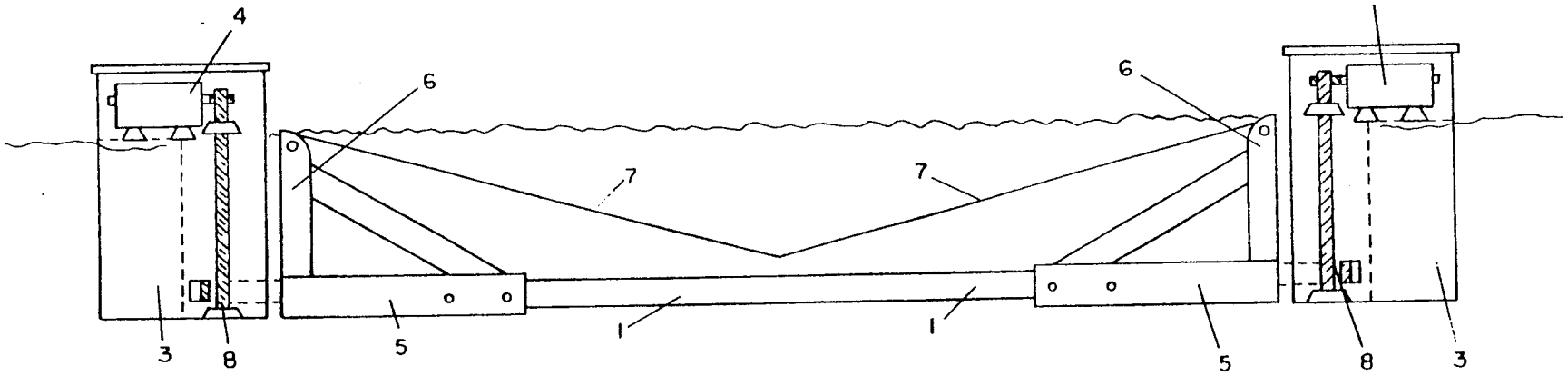
FIG. 2*b* is an end view of one half of the system showing the tanks flooded and lift beams down.
Figure 3:
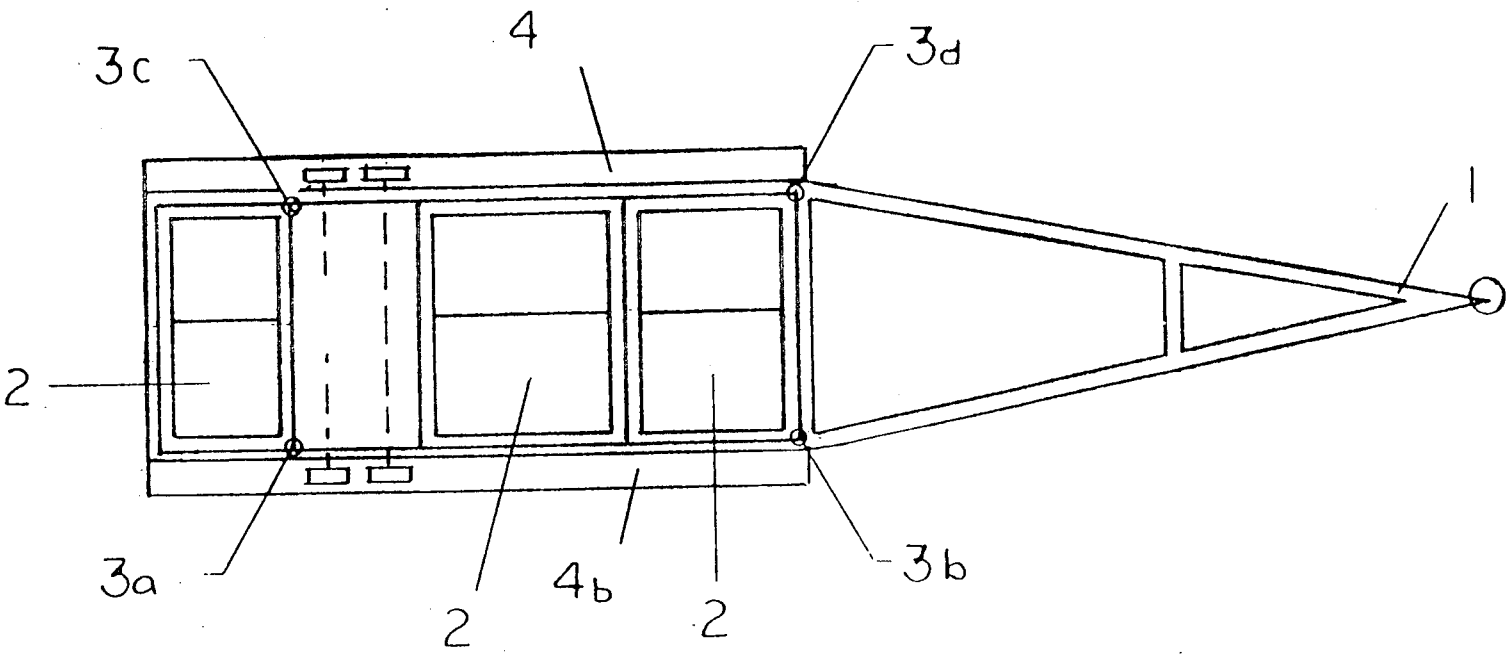
FIG. 3 is a top view of the system adapted to a boat trailer.

For the purpose of entering the lift with a boat, the floatation tanks will be flooded lowering their top surfaces to within six inches of the water and their bottom surfaces will be 2½ feet below the water, (if the tanks are hypothetically 3 feet tall). The tanks will never be totally submerged since the drive winches will be located under the deck in individual compartments (FIGS. 1—5*a,b,c,d* and FIGS. 2–4). The lift beams will be concurrently screwed to their lowest position at the bottom surfaces of the tanks (if the beams are hypothetically 6 inches tall). There is at this point 2 feet to 2½ feet (depending on capacity and assembly of said boatlift) of draft for boat entry (FIG. 2*b*). The average hull draft of a 20 foot—28 foot pleasure boat is approximately 14 inches–18 inches depending on type and manufacturer. The shalloow draft character of this invention becomes obvious since the boat needs only 6 inches of water beneath its keel to enter the boatlift. At this point the water is pumped out of the tanks creating lift beneath the hull of the boat and partially raising the boat out of the water. As the vessel's waterline starts raising above the water the feed screws (FIGS. 1—2*a* and 2*b*) will be engaged creating the finishing lift needed to raise the vessel to a point at which the keel exits the water (FIG. 2*a*).

Since there is no super structure on this lift, it is obviously low profile. This is more than aesthetic in nature because there are no beams and machinery to climb over or under allowing easy boat boarding and deboarding.

In addition to the basic request for patent on the shallow draft, floating boatlift there are other claims being made. FIG. 1 shows fixed beams (FIGS. 1—3*a* and 3*b*) and lift beams (FIGS. 1—2*a* and 2*b*) sectioned with a beam in a sleeve in each instance. This option allows telescopic width adjustment making it possible to fit different width vessels.

Figure 5B:
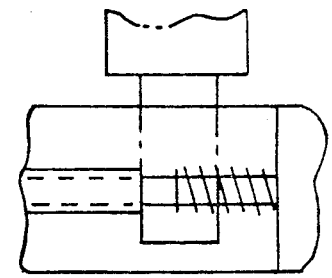
FIGS. 5*a* and 5*b* are sideviews of the feedscrew ends showing threadless stops.
Figure 5A:
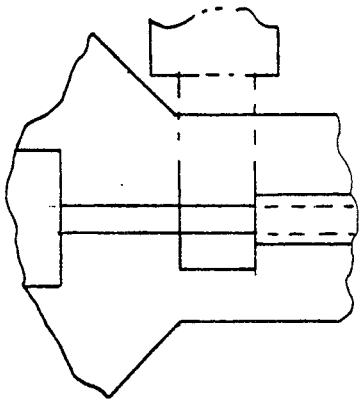

Another design feature pertains to the feed screws having no threads at the top and bottom 6 inches (FIGS. 5*a* and 5*b*. This disallows overwinding which if done would be damaging and potentially dangerous.

Another feature has to do with the method for cradling the vessel on the lifting beams. The inventor proposes suspending straps (FIGS. 2—7) from the triangles (FIGS. 2—6) at the extreme ends of each lift beam (FIGS. 2—1). This accomplishes several things: straps take up very little space, they are non abrasive to said vessel, and they spread the load over a longer line. Mostimportantly, the vessel does not touch the beams' centers, consequently; most of the downward load of the boat is at the extreme beam ends vastly reducing the tendency of the floats to envelope (fold up and in). Using lifting straps is not a unique idea, however; using them in conjunction with rigid lifting beams is. Lift straps normally extend above the gunnel (point at which boat side and boat deck meet) of the vessel being lifted, and ending at the lift super structure such as in a boathouse lift. This new method will maintain a low profile since the strapping extends only to the chine (point at which boat side and boat bottom meet) of the vessel being lifted. This system also allows a reduction in material cost for producing said boatlift. The normal cradle system presently utilized consists of wooden 4"×4"s perpindicular to or horizontal with the boat's keel (depending upon vessel size and type). In either application the downward loading is in the center one-third of the lift beams.

Figure 4:
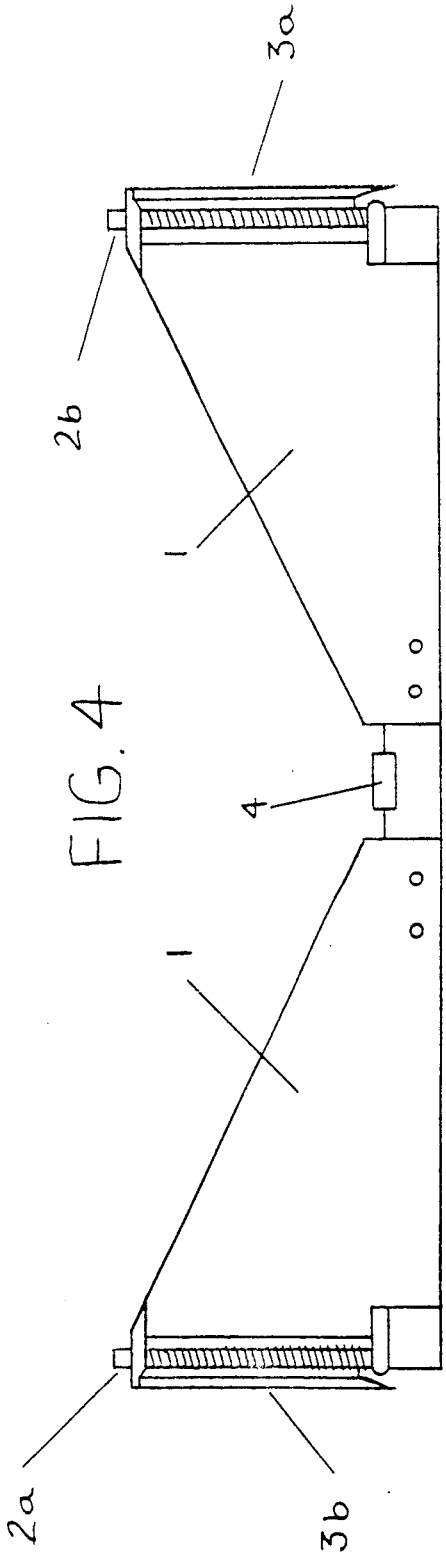
FIG. 4 is an end view of the system that is adaptable to a boat trailer.

Another claim being made by this inventor is the same hydro-mechanical principle being applied as an add on system to an existing boat trailer. By attaching screw collars to the trailer frame, placing triangular shaped buoyancy tanks beneath and up between trailer members and feeding screws through the add on collars to the tanks, a floating lift trailer will be accomplished (FIG. 4). These tanks will have to be customized to the particular trailer allowing for the different designs.

Cradling systems will not be addressed since they are already incorporated in said trailers. The operation will be the same for the trailer lift system except the complete trailer will be screwed up or down in conjunction with or opposition to said buoyancy tank. These lifts are of special interest to boat racers. Racers will not have to wait for the crane to load and unload their vessels between heats with a trailer float lift.

The winches or power mechanisms will not be discussed since there are several currently produced that may be purchased and utilized, and the inventor makes no claim here. Mooring methods similarly will not be claimed since there are many and they have no bearing here.

What is claimed is:

1. A shallow draft boatlift comprising:

two elongated spaced apart floatation chambers, each said floatation chamber includes a means for varying the buoyancy thereof, said floatation chambers having lower surfaces; a boat hull engaging means comprising a low profile beam having a lower surface; a lifting means operably inter-connected between said floatation chambers and said boat hull engaging means adapted to raise and lower said boat hull engaging means and a boat there atop between a first position having the lower surfacee of the beam adjacent to the lower surface of said floatation chambers to a second raised position; said floatation chambers adapted to buoyantly support said lifting means, said boat hull engaging means and a boat positioned there atop whereby the height of said beam substantially defines the height of the boat hull engaging means which is lowered under a hull.

2. A boat lift as set forth in claim 1, wherein:

said lifting means is a plurality of spaced apart upright feed screws each rotatably drivable and operably inter-engaged between each said floatation chamber and said boat hull engaging means such that an equal number of said feed screws are distributed between each said floatation chamber and each side of said boat hull engaging means.

3. A boatlift as set forth in claim 2, wherein:

said lifting means includes an automatic stop to interrupt raising and lowering of said boat lift engaging means at its upper and lower ends of travel with respect to said floatation chambers.

4. A boatlift as set forth in claim 1, wherein:

said boat hull engaging means is a towable boat trailer; said boatlift includes said floatation chambers and said lifting means and is removably interconnected with said boat trailer.

5. A boatlift as set forth in claim 1, wherein:

said floatation chambers are inter-connected at their bottom surfaces with a fixed means for the purpose of stabilizing said floatation chambers.

6. A boatlift as set forth in claim 5, wherein:

said floatation chambers stabilizing means and said boat hull engaging means are adapted to telescope for the purpose of adjusting width.

7. A boatlift as set forth in claim 1, wherein:

said boat hull engaging means is fitted with truncated triangles at its extreme sides, said triangles are fitted with slings from the top of each triangle to the opposing triangle across the beam width for positioning a boat there atop for the purpose of transferring hull weight away from the center of said boat hull engaging means.

8. A shallow draft boatlift comprising:

two elongated spaced apart floatation chambers, each said floatation chamber includes a means for varying the buoyancy there of, said floatation chambers having lower surfaces; a boat hull engaging means having a lower surface; a lifting means operably inter-connected between said floatation chambers and said boat hull engaging means adapted to raise and lower said boat hull engaging means and a boat there atop between a first position having the lower surface of the boat engaging means adjacent to the lower surface of said floatation chambers to a second raised position; said floatation chambers adapted to buoyantly support said lifting means, said boat hull engaging means and a boat positioned there atop, said boat hull engaging means is a towable boat trailer; said boatlift includes said floatation chambers and said lifting means and is removably inter-connected with said boat trailer.

9. A shallow draft boatlift comprising:

two elongated spaced apart floatation chambers, each said floatation chamber includes a means for varying the buoyancy there of, said floatation chambers having lower surfaces; a boat hull engaging means having a lower surface; a lifting means operably inter-connected between said floatation chambers and said boat hull engaging means adapted to raise and lower said boat hull engaging means and a boat there atop between a first position having the lower surface of the boat engaging means adjacent to the lower surface of said floatation chambers to a second raised position; said floatation chambers adapted to buoyantly support said lifting means, said boat hull engaging means and a boat positioned there atop, said floatation chambers are inter-connected at their bottom surfaces with a fixed means for the purpose of stabilizing said floatation chambers, said floatation chambers stabilizing means and said boat hull engaging means are adapted to telescope for the purpose of adjusting width.

* * * * *